US005138864A

United States Patent [19]

Tarpill

[11] Patent Number: 5,138,864

[45] Date of Patent: Aug. 18, 1992

[54] CRIMPING TOOL

[75] Inventor: Andrew J. Tarpill, East Haddam, Conn.

[73] Assignee: Ripley Company, Inc., Cromwell, Conn.

[21] Appl. No.: 785,220

[22] Filed: Oct. 28, 1991

Related U.S. Application Data

[63] Continuation of Ser. No. 635,671, Dec. 28, 1990, abandoned.

[51] Int. Cl.[5] ..... H01R 43/042

[52] U.S. Cl. ..... 72/410; 72/416; 29/751

[58] Field of Search ..... 72/410, 409, 416; 29/751; 81/424.5, 418, 426.5

[56] References Cited

U.S. PATENT DOCUMENTS

| | | | |
|---|---|---|---|
| 576,503 | 2/1897 | Williams . | |
| 2,009,829 | 7/1935 | Williams | 72/409 |
| 2,411,838 | 11/1946 | Swengel | 29/751 |
| 2,684,003 | 7/1954 | Klingler | 29/751 |
| 2,684,004 | 7/1954 | Holtzapple | 29/751 |
| 2,696,747 | 12/1954 | Bergan . | |
| 2,952,175 | 9/1960 | Edlen | 72/409 |
| 3,205,568 | 9/1965 | Stull | 72/410 |
| 3,284,885 | 11/1963 | Fisher et al. . | |
| 3,438,407 | 4/1969 | Over . | |
| 3,484,922 | 12/1969 | Fritz et al. . | |
| 3,487,524 | 11/1967 | Filia . | |
| 3,504,417 | 4/1970 | Filia . | |
| 3,523,351 | 8/1970 | Filia . | |
| 3,557,429 | 10/1967 | Parsons . | |
| 3,711,942 | 1/1973 | Reynolds . | |
| 3,803,897 | 4/1974 | Ridenour | 72/412 |
| 4,590,786 | 5/1986 | Wiener et al. . | |
| 4,611,511 | 9/1986 | Mykkanen | 72/410 |
| 4,630,462 | 12/1986 | Wiener et al. . | |
| 4,719,789 | 1/1988 | Wiebe | 29/751 |
| 4,825,735 | 5/1989 | Undin | 72/409 |
| 4,829,805 | 5/1989 | Koehn . | |

FOREIGN PATENT DOCUMENTS

| | | | |
|---|---|---|---|
| 70159 | 10/1915 | Fed. Rep. of Germany | 72/409 |
| 1355932 | 6/1987 | France | 29/751 |

*Primary Examiner*—Daniel C. Crane
*Attorney, Agent, or Firm*—DeLio & Associates

[57] ABSTRACT

A hand tool having upper and lower jaws with a pair of complimentary solid die surfaces for contacting and compressing substantially the entire periphery of a cable connector sleeve. A plurality of plate-like intermeshing teeth and slots extend away from a pivot pin for the jaws in planes substantially perpendicular to the longitudinal axis of the pivot pin and the connector and form a U shaped opening adjacent a die surface on each of the jaws for receiving and enclosing the connector as it is compressed. At least some portions of the teeth and slots remain intermeshed as the jaws move to the opened position. The meshing slots and teeth have facing ends spaced from one another except for portions thereof contacting each other to limit closure of the jaws as the die surfaces close and compress and crimp to connector to a desired degree onto said cable. The portions of the ends of the meshing slots and teeth contacting each other are adjacent to the die surfaces.

22 Claims, 3 Drawing Sheets

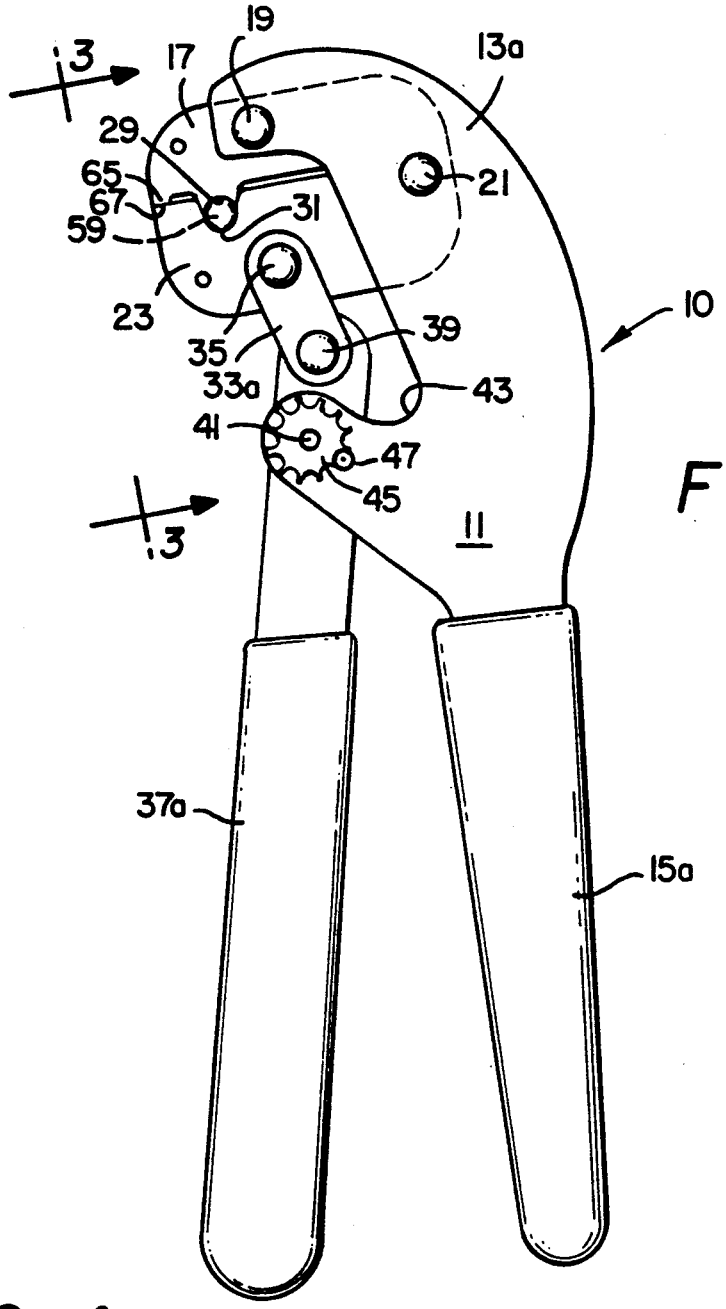
FIG. 1
FIG. 4
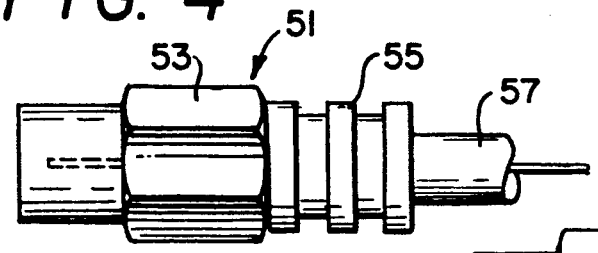
FIG. 5
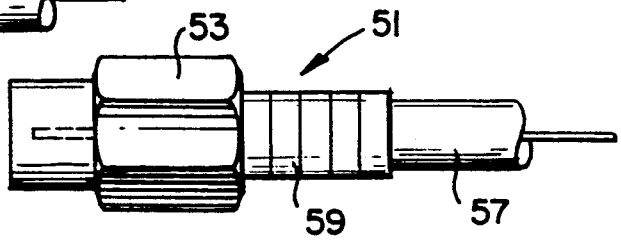

FIG. 2
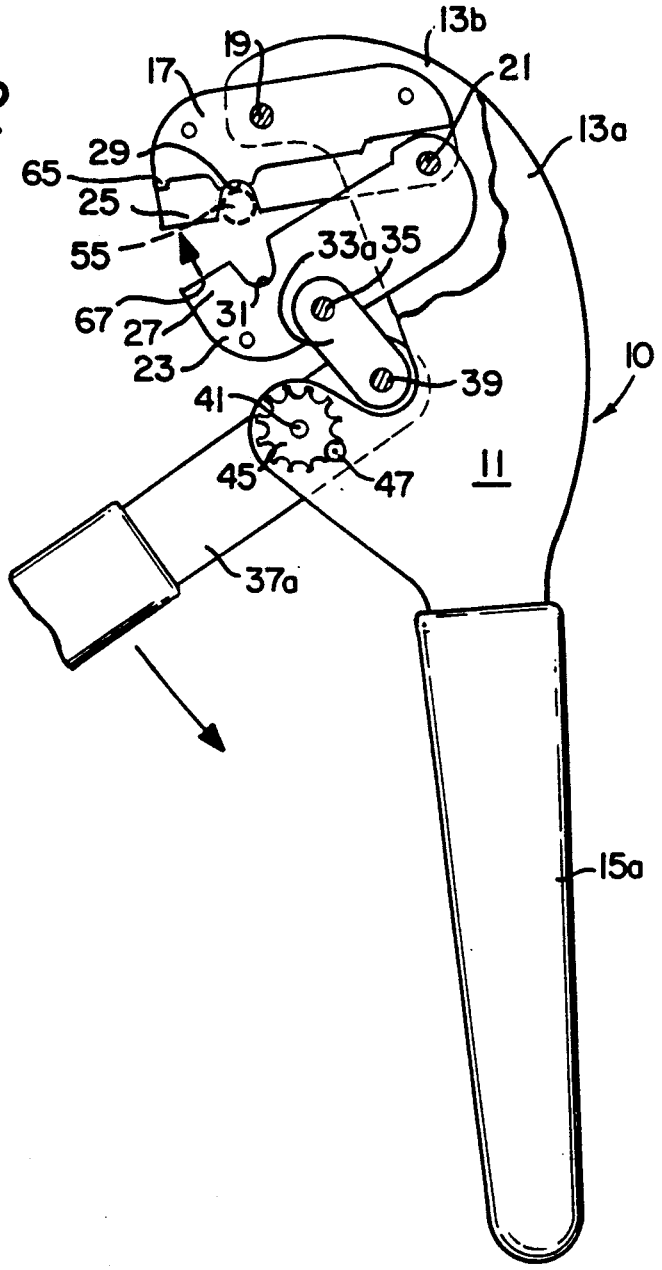
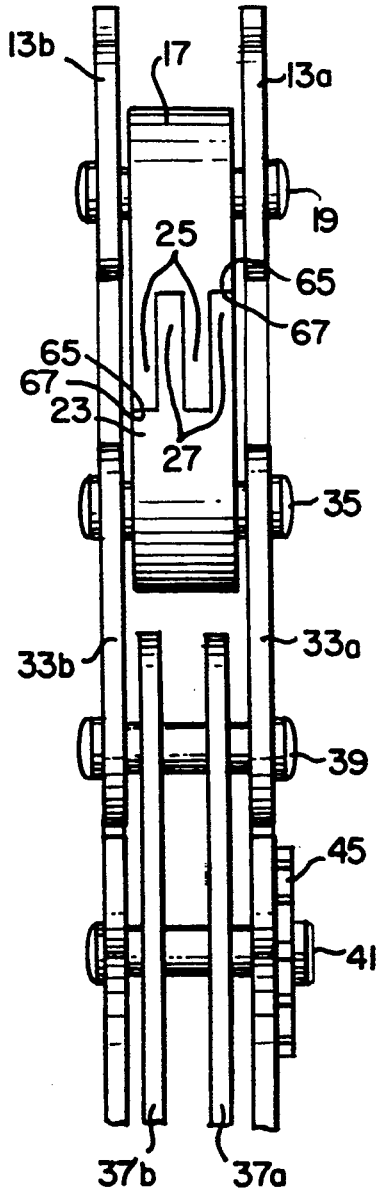
FIG. 3

FIG. 6
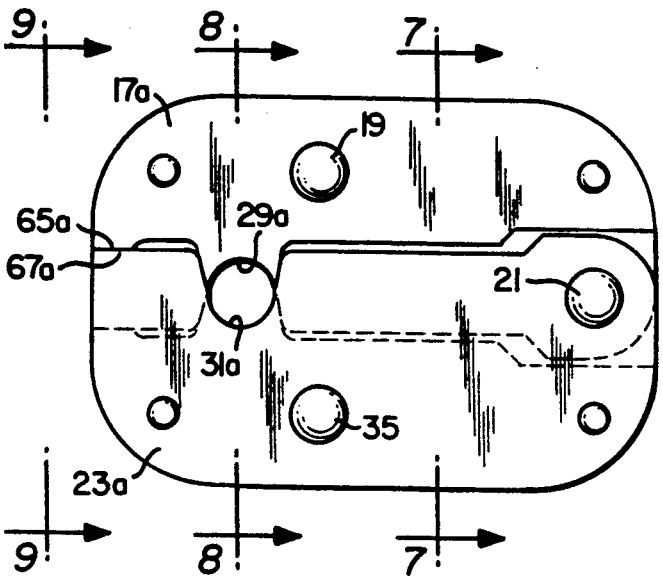
FIG. 9
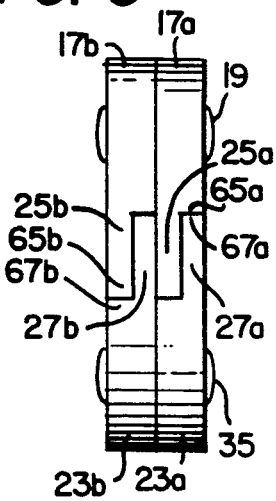
FIG. 8
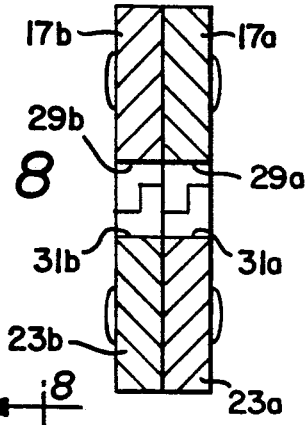
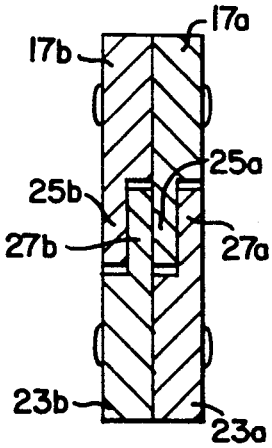
FIG. 7
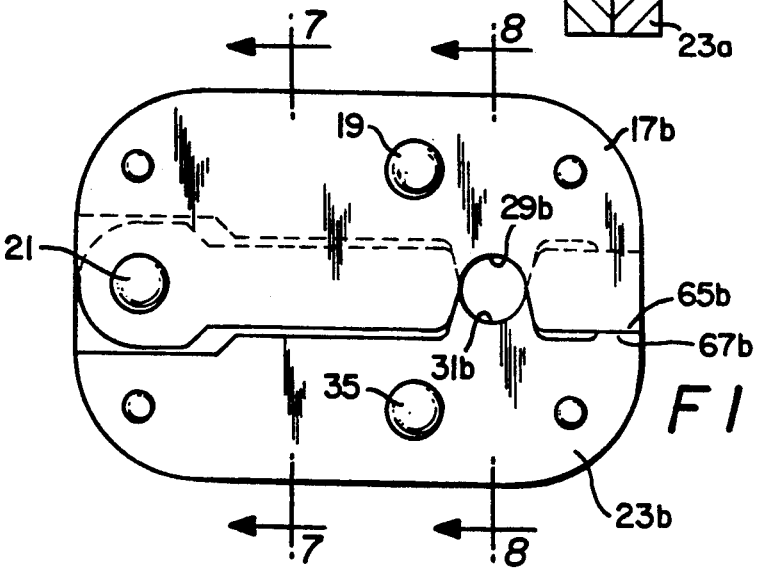
FIG. 10

CRIMPING TOOL

This is a continuation of co-pending application Ser. No. 635,671 filed on Dec. 28, 1990, now abandoned.

BACKGROUND OF THE INVENTION

This invention relates to a tool for securing a connector onto a cable and, in particular, a hand held and operated tool for crimping the sleeve of a cable connector onto coaxial cable or the like.

Crimping tools for securing connectors to electrical or communication cable have been used for many years. In the instances where a tubular connector sleeve slips over the outside of the end of the cable, the tools have generally been designed with crimping jaws which utilize die surfaces to plastically deform the sleeve onto the cable end to create a tight compression fit. These tools are widely used not only in the manufacturing of cables, but also by service people installing cable or the like. Hand held and operated crimping tools which have normally been used by such service people have generally not been able to crimp and form the connector sleeve onto the cable end with great precision. Precision in crimping and forming the connector is desirable in more critical applications such as where the finished connection must be waterproof. For typical cable connectors, such as those for 50 or 75 ohm coaxial cable or the like, the tolerance of the final crimped diameter of the connector sleeve may be required to be no more than about 0.001 inches.

Prior art crimping tolls have not been able to consistently meet the requirements for precision crimping by hand of tube type connectors onto cable ends. Such crimping tools, some of them being hand held and operated tools, are exemplified in U.S. Pat. Nos. 576,503, 2,696,747; 3,284,885; 3,438,407; 3,484,922; 3,487,524; 3,504,417; 3,557,429; 3,711,942; 4,590,786; 4,630,462 and 4,829,805, but these tools are not useful for hand crimping a slip-over, tube type connector into a precise, uniform diameter.

Bearing in mind the problems and deficiencies of the prior art, it is therefore an object of the present invention to provide a tool for crimping a cable connector onto a cable which produces a uniformly round diameter, tight fitting connector sleeve over the cable end.

It is another object of the present invention to provide a cable connector crimping tool which has the ability to make a water tight connection between the connector and the cable.

It is a further object of the present invention to provide a tool for crimping a cable connector onto a cable which produces a precise, predetermined diameter on the crimped and formed connector sleeve.

It is yet another object of the present invention to provide a hand held and operated tool which meets the above objects.

It is a further object of the present invention to provide a hand held crimping tool which is easy to use yet precise in operation.

SUMMARY OF THE INVENTION

The above and other objects, which will be apparent to those skilled in the art, are achieved in the present invention which relates to a tool for crimping a cable connector onto a cable comprising upper and lower jaws joined by a pin in pivoting relationship and movable between opened and closed positions. The upper and lower jaws have a pair of complimentary curved die surfaces for contacting and compressing the cable connector and a plurality of plate-like intermeshing teeth and slots extending away from the pivot pin in planes substantially perpendicular to a longitudinal axis of the pivot pin and the connector, and adjacent to the die surfaces, for enclosing the cable connector as it is compressed. Preferably, at least some portions of the teeth and slots remain intermeshed as the jaws move to the opened position.

The die surfaces are preferably solid and configured to contact and compress substantially the entire periphery of the cable connector sleeve. The teeth and slots may form a U shaped opening adjacent a die surface on each of the jaws for receiving and enclosing the connector as it is compressed. The slots and teeth have facing ends spaced from one another except for portions of at least one of the ends of the meshing slots and teeth which contact each other to limit closure of the jaws as the die surfaces close toward each other and compress and crimp the connector to a desired degree onto said cable. Preferably, the portions of the ends of the meshing slots and teeth contacting each other are adjacent to the die surfaces.

In another aspect, the present invention relates to a hand held tool for crimping a cable connector onto a cable which comprises a frame having an elongated handle extending therefrom and a second elongated handle joined in pivoting relationship to the frame. The tool described above is incorporated into the frame wherein the upper jaw is secured to the frame and the lower jaw is joined by a pin in pivoting relationship to the upper jaw. A link is joined in pivoting relationship to both the lower jaw and the second handle whereby relative movement of the handles toward each other causes the jaws to close about the cable connector sleeve.

BRIEF DESCRIPTION OF THE DRAWINGS

FIG. 1 is a side elevational view of a hand held and operated tool according to a first embodiment of the present invention shown in its closed position crimping a cable connector sleeve.

FIG. 2 is a side elevational view, partially cut away, showing the tool of FIG. 1 in an opened position.

FIG. 3 is an end elevational view of the upper portion of the tool depicted in FIG. 1, as seen from the left.

FIG. 4 is a side elevational view of an uncrimped cable connector slipped over the end of a coaxial cable.

FIG. 5 is a side elevational view of the cable and connector of FIG. 4 after crimping by the tool of the present invention.

FIG. 6 is a side elevational view of an alternate embodiment of the jaws of the tool depicted in FIG. 1.

FIG. 7 is a sectional view of the jaws of FIG. 6, taken along line 7—7.

FIG. 8 is a sectional view of the jaws of FIG. 6, taken along line 8—8.

FIG. 9 is an end elevational view of the jaws of FIG. 6, taken along line 9—9.

FIG. 10 is a side elevational view of the opposite side of the jaws depicted in FIG. 6.

DETAILED DESCRIPTION OF THE INVENTION

The tool of the present invention is especially useful in crimping the sleeve of a connector of coaxial cable over the outside of the cable end, but may also be employed in crimping connectors onto other types of cable such as electrical or communications cables. The preferred embodiments of the tool of the present invention are depicted in the drawings in Figs. 1-10 in which like numerals refer to like features of the invention. The preferred embodiments are made from conventional materials such as steel or steel alloys, except where noted below.

A first embodiment of the present invention is depicted in FIGS. 1-3 as a hand held and hand operated tool 10. The hand held tool 10 includes a main frame member 11 with a generally C shaped upper portion and an elongated handle extending downwardly therefrom. Frame 11 is composed of two (2) parallel members. As seen in the end view of FIG. 3, the upper C shaped portion members 13*a* and 13*b* are parallel and are disposed on opposite sides of the tool jaws 17 and 23. The downwardly extending handle member portion is made up of parallel members 15*a* and 15*b* (not shown) which may be fastened together in a desired spaced relationship and covered with a plastic coating or the like to assist in gripping.

Parallel movable handle members 37*a* and 37*b* are secured together and mounted in pivoting relationship to the lower C shaped portion of main frame 11 by a cam pin 41. The lower portions of handle members 37*a* and 37*b* extend downwardly from pin 41 and may also be covered with plastic or the like to assist hand gripping in connection with handle portions 15*a* and 15*b*. The upper ends of handle segments 37*a* and 37*b*, above pin 41, are connected in pivoting relationship to identical link members 33*a* and 33*b* by pin 39. Parallel links 33*a* and 33*b* are themselves connected in pivoting relationship on either side of lower jaw member 23 by pin 35. A cut-out relief area 43 (FIG. 1) provides room for movement of the upper ends of handle 37*a,b* as the jaws are opened (FIG. 2).

Upper jaw member 17 is secured to and between the upper portion of C shaped members 13*a* and 13*b* by pin 19. Jaw members 17 and 23 are secured in pivoting relationship with each other by pin 21 which is also secured to and extends between members 13*a* and 13*b*.

The general type of tool frame described above is similar to other tool frames used in the past and constitutes a portion of the invention described herein only in combination with the novel jaws 17 and 23.

Integral upper and lower jaw members 17 and 23, respectively, are made for example by powder metal fabrication techniques and are specially configured to accomplish the objects of the invention including the object of providing a close tolerance, round, crimped cable sleeve over the cable end. The elongated jaw members are pivotable around pin 21 at one end between an opened position (FIG. 2) and a closed position (FIG. 1). Near their ends opposite pin 21, the jaws contain complimentary curved die surfaces 29, 31 for contacting and compressing substantially the entire periphery of the cable connector sleeve. In the side view as shown in FIG. 1 and 2, these die surfaces form a generally U shape with the radius of the surface at the bottom of the U being that of the desired crimped connector sleeve radius. Preferably, these die surfaces are smooth and solid so as not to impress any marks on the connector sleeve. Instead of the segments of a circle as shown in the figures, these die surfaces 29, 31 may have any other configuration, depending upon the desired crimped configuration of the connector sleeve. The radius of the die surfaces should be made to close tolerance equalling the dimensions of the final crimped connector sleeve.

Extending in planes essentially perpendicular to the longitudinal axis of pivot pin 21 and the connector as it is received in the die surfaces, and extending from pin 21 to the opposite end of the jaw members, are a plurality of intermeshing plate-like teeth 25, 27 and slots (i.e., the spaces between the teeth) along the facing surfaces of jaw members 17, 23, respectively. The number of slots and teeth to be used in the tool can vary, depending on the desired application. When seen in the side views of FIGS. 1 and 2, these teeth and slots have U shaped openings corresponding to and extending away from the die surfaces of the respective jaw members. The portions of the intermeshing teeth immediately adjacent to the die surfaces enclose the cable connector sleeve as it is compressed to prevent undesired deformation of the sleeve outside of the die surfaces. Additionally, these teeth and slots remain intermeshed at the ends of the jaw members near pin 21 as the jaws move between the opened and closed position to ensure a smooth and accurate closure of the die surfaces around the cable connector. Without such constant intermeshing of at least a portion of the teeth and slots as the the upper and lower jaw members pivot, the die surfaces 29 and 31 may be more easily become misaligned due to normal wear and/or misuse.

The present invention also provides a positive stop arrangement so that the closing movement of the jaws will be limited to the degree required for the desired final, formed diameter of the sleeve. This is provided at the ends of the jaw members opposite pin 21 (adjacent die surfaces 29, 31) wherein raised or extended portions of the facing ends of the slots make direct contact with ends of the teeth when the jaw members are fully closed and the die surfaces form the opening of the desired dimension. As shown in FIGS. 1 and 3 in the tool and jaw closed position, these stop portions are indicated as 65 on the upper jaw members and 67 on the lower jaw member. Except for these stop portions, the remaining ends of the fully meshing slots and teeth are spaced slightly from one another. This can be seen best in the side view of FIG. 1 with the jaws in the closed position wherein end portion 67 of tooth 27 of the lower jaw member is shown contacting the slightly extended end 65 of the slot of the upper jaw member. Without such positive stop members on the upper and lower jaws, it may be possible for the user of the tool of the present invention to inadvertently crimp the connector sleeve beyond the precise diameter desired.

The type of cable connector and cable for which the present invention is most useful is depicted in FIGS. 4 and 5. In FIG. 4, the uncrimped connector 51 is shown slipped loosely over the end of a coaxial cable 57. Connector 51 includes the plastically deformable connector sleeve 55 and the rotatable hex nut 53 which is used to secure the completed cable end to another cable or jack. In FIG. 5, the connector is shown after crimping by the tool of the present invention with the fully crimped sleeve 59 tightly securing the connector to the cable 57.

An alternate form of the jaw members shown in FIGS. 1-3 is depicted in FIGS. 6-10. These jaw members form essentially the same configuration of the jaw members described above except that, instead of each jaw being made as a unitary or integral member, each is made up of two (2) or more laminates. The corresponding features of the jaw members previously described are identified by the same numbers, except that the letters "a" and "b" are used to distinguish the features of the two (2) separate laminate portions shown.

As shown in the FIGS. 6–10, each of the jaw members 17*a*, 17*b*, and 23*a*, 23*b* include one tooth and one slot so that, when placed in abutting side-by-side relationship as depicted, they form the same two (2) teeth, two (2) slot configuration of the jaw members of FIGS. 1–3. The jaw members 17*a*, 17*b*, and 23*a*, 23*b* are received in the tool frame and pivoted in the same manner as previously described, and operate in all ways in the same manner as previously described. Each of the die surfaces, 29*a*, 29*b*, and 31*a*, 31*b* likewise have solid surfaces which, when the jaws are fully closed, contact and compress substantially the entire periphery of the cable connector sleeve. Also, facing the ends of the teeth 25*a*, 25*b*, 27*a*, 27*b* of the upper and lower jaw members are spaced slightly apart from one another (as in FIG. 7) with the exception of the portions 65*a* and 67*a* which contact each other to provide the positive stop which enables the die surfaces to form the proper diameter crimped connector when the jaws are fully closed.

To operate the hand tool of the present invention, the handle 37*a,b* is pulled away from handle 15*a,b* to open the jaw members as shown in FIG. 2. The sleeve 55 of the connector depicted in FIG. 4 is then placed within the jaw opening between the die surfaces 29 and 31, with the connector 51 and cable 57 (not shown) longitudinal axes normal to the plane of the drawing sheet.

Thereafter, the handle members are grasped by hand to move handle 37*a,b* in the direction shown by the arrow until it reaches the position shown in FIG. 1 in which the jaw members 17, 23 are fully closed and the upper and lower jaw positive stop portions 65, 67 are in contact. In this regard, it should be noted that the leverage provided by the motion of the upper end of handle 37*a,b* through links 33*a*, 33*b* is a compound lever action which results in increased compression force on the connector sleeve. As in previous similar types of tool frames, pin 41 is slightly offset from its axis to form a cam so that adjustment may be made to ensure that the jaw members fully close and provide maximum compression force when the handles 37*a,b* and 15*a,b* are brought together. Cam-pin 41 may be adjusted by removing screw 47 and turning the cam adjustment wheel 45.

Following closure of the jaw members, the sleeve 59 of cable connector 51 is then fully compressed to the desired close tolerance formed by the die surfaces 29, 31 within their U shaped jaw openings. Thus the present invention fulfills the various objects listed above and, in particular, provides a useful tool for crimping cable connector sleeves over cable ends to tight tolerances, for example, those required to make the connection watertight.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustrations which do not constitute departure from the spirit and scope of the invention.

Having thus described the invention, what is claimed is:

1. A tool for crimping a cable connector onto a cable comprising upper and lower jaws joined by a pin in pivoting relationship and movable between opened and closed positions, said upper and lower jaws each having a complimentary solid, curved die surface for contacting and compressing the cable connector and a plurality of sliding, intermeshing teeth and slots extending from said pin to and past the die surfaces in flat planes substantially perpendicular to a longitudinal axis of the connector and said pin and adjacent to the die surfaces for enclosing the cable connector as it is compressed, said teeth and slots on each of said upper and lower jaws having a stepped cross-section taken along a plane extending parallel to the axis of the pivot, said sliding slots and teeth remaining intermeshed as said jaws pivot between open and closed positions to prevent misalignment and having ends spaced from one another except for portions of at least one of the ends of the meshing slots and teeth contacting each other when said jaws are in a sully closed position and said die surfaces compress and crimp said connector to a desired degree onto said cable.

2. The tool of claim 1 wherein said teeth and slots form a U shaped opening adjacent a die surface on each of said jaws for receiving and enclosing said connector as it is compressed.

3. The tool of claim 1 wherein at least some portions of said teeth and slots remain intermeshed as said jaws move to said opened position.

4. The tool of claim 1 wherein the portions of the ends of the meshing slots and teeth contacting each other are adjacent to the die surfaces.

5. A hand held tool for crimping a cable connector onto a cable comprising:

a frame having an elongated handle extending therefrom;

a second elongated handle joined in pivoting relationship to said frame;

an upper jaw secured to said frame;

a lower jaw joined by a pin in pivoting relationship to said upper jaw, said pin located at one end of each of said jaws; and a link joined in pivoting relationship to both said lower jaw and said second handle whereby relative movement of said handles toward each other causes said jaws to close, said upper and lower jaws having a pair of complimentary curved die surfaces adapted for contacting and compressing the cable connector to the same diameter and a plurality of sliding, intermeshing teeth and slots extending from said pin to the die surfaces in flat planes substantially perpendicular to and past a longitudinal axis of the connector and said pin and forming a U shaped opening adjacent to the die surfaces for enclosing the cable connector as it is compressed, said teeth and slots on each of said upper and lower jaws having a stepped cross-section taken along a plane extending parallel to the axis of the pivot, said sliding slots and teeth remaining intermeshed as said jaws pivot between open and closed positions to prevent misalignment.

6. The tool of claim 5 wherein at least some portions of said teeth and slots remain intermeshed as said jaws move to said opened position.

7. The tool of claim 6 wherein said slots and teeth have ends spaced from one another except for portions of at least one of the ends of the meshing slots and teeth adjacent the die surfaces which contact each other as said jaws close toward each other and said die surfaces compress and crimp said connector to a desired degree onto said cable.

8. The tool of claim 6 wherein said die surfaces are solid.

9. The tool of claim 6 wherein said pin passes through said teeth and slots.

10. A hand held tool for crimping a cable connector onto a cable comprising:

a frame having an elongated handle extending therefrom;

a second elongated handle joined in pivoting relationship to said frame;

an upper jaw secured to said frame;

a lower jaw joined by a pin in pivoting relationship to said upper jaw, said jaws being movable between fully opened and fully closed positions; and a link joined in pivoting relationship to both said lower jaw and said second handle whereby relative movement of said handles toward each other causes said jaws to close, each upper and lower jaw having a complimentary solid, curved die surface moveable in unison for contacting and compressing the cable connector and a plurality of sliding, intermeshing teeth and slots extending from said pin to the die surfaces in flat planes substantially perpendicular to and past a longitudinal axis of the connector and said pin and adjacent to the die surfaces for enclosing the cable connector as it is compressed, said teeth and slots on each of said upper and lower jaws having a stepped cross-section taken along a plane extending parallel to the axis of the pivot, said sliding slots and teeth remaining intermeshed as said jaws pivot between open and closed positions to prevent misalignment, at least some portions of said teeth and slots remaining intermeshed when said jaws are in a fully opened position.

11. The too of claim 10 wherein said slots and teeth have ends spaced from one another except for portions of at least one of the ends of the meshing slots and teeth which contact each other as said jaws close toward each other and said die surfaces compress and crimp said connector to a desired degree onto said cable.

12. The tool of claim 11 wherein at least some portions of said teeth and slots remain intermeshed as said jaws move to an opened position.

13. The tool of claim 11 wherein the portions of the ends of the meshing slots and teeth contacting each other are adjacent to the die surfaces.

14. A hand held tool for crimping a cable connector onto a cable comprising:

a frame having an elongated handle extending therefrom;

a second elongated handle joined in pivoting relationship to said frame;

an upper jaw secured to said frame;

a lower jaw joined by a pin in pivoting relationship to said upper jaw; and a link joined in pivoting relationship to both said lower jaw and said second handle whereby relative movement of said handles toward each other causes said jaws to close, each upper and lower jaw having a complimentary curved die surface for contacting and compressing the cable connector and a plurality of sliding, intermeshing teeth and slots extending from said pin to and past the die surfaces in flat planes substantially perpendicular to a longitudinal axis of the connector and said pin and adjacent to the die surfaces for enclosing the cable connector as it is compressed, said teeth and slots on each of said upper and lower jaws having a stepped cross-section taken along a plane extending parallel to the axis of the pivot, said sliding slots and teeth remaining intermeshed as said jaws pivot between open and closed positions to prevent misalignment, said slots and teeth having ends spaced from one another except for at least a portion of at least one of the ends of the meshing slots and teeth contacting each other when said jaws are fully closed to limit the degree to which said die surfaces compress and crimp said connector onto said cable.

15. The tool of claim 14 wherein said teeth and slots form a U shaped opening adjacent a die surface on each of said jaws for receiving and enclosing said connector as it is compressed.

16. The tool of claim 15 wherein at least some portions of said teeth and slots remain intermeshed as said jaws move to said opened position.

17. The tool of claim 15 wherein the portions of the ends of the meshing slots and teeth contacting each other are adjacent to the die surfaces.

18. A hand held tool for crimping a cable connector onto a cable comprising:

a frame having an elongated handle extending therefrom;

a second elongated handle joined in pivoting relationship to said frame;

an upper jaw secured to said frame;

a lower jaw joined by a pin in pivoting relationship to said upper and jaw and movable between opened and closed positions relative thereto; and a link joined in pivoting relationship to both said lower jaw and said second handle whereby relative movement of said handles toward each other causes said jaws to close, said upper and lower jaws each having a complimentary solid die surface for contacting and compressing the cable connector and a plurality of sliding, intermeshing teeth and slots extending from said pin to and past the die surfaces in flat planes substantially perpendicular to a longitudinal axis of the connector and said pin and adjacent to the die surfaces for enclosing the cable connector as it is compressed, at least some portions of said teeth and slots remaining intermeshed when said jaws are in a fully opened position, said teeth and slots on each of said upper and lower jaws having a stepped cross-section taken along a plane extending parallel to the axis of the pivot, said sliding slots and teeth remaining intermeshed as said jaws pivot between open and closed positions to prevent misalignment, the meshing slots and teeth having ends spaced from one another except for portions thereof contacting each other when said jaws are in a fully closed position and said die surfaces compress and crimp said connector to a desired degree onto said cable.

19. The tool of claim 18 wherein said teeth and slots form a U shaped opening adjacent a die surface on each of said jaws for receiving and enclosing said connector as it is compressed.

20. The tool of claim 19 wherein the portions of the ends of the meshing slots and teeth contacting each other are adjacent to the die surfaces.

21. A tool for crimping a cable connector onto a cable comprising one upper and one lower jaw joined by a pin in pivoting relationship and movable between opened and closed positions, said upper and lower jaws having a pair of complimentary solid, curved die surfaces for contacting and compressing substantially the entire periphery of the cable connector and a plurality of sliding, intermeshing teeth and slots extending from said pin to and past the die surfaces in flat planes substantially perpendicular to a longitudinal axis of the connector and said pin and forming a U shaped opening adjacent a die surface on each of said jaws for receiving and enclosing said connector as it is compressed, at least some portions of said teeth and slots remaining intermeshed when said jaws are in a fully opened position, said teeth and slots on each of said upper and lower jaws having a stepped cross-section taken along a pane extending parallel to the axis of the pivot, said sliding slots and teeth remaining intermeshed as said jaws pivot between open and closed positions to prevent misalignment and having ends spaced from one another except for portions of at least one of the ends of the meshing slots and teeth contacting each other when said jaws are in a fully closed position to limit closure of said jaws as said die surfaces close toward each other and compress and crimp said connector to a desired degree onto said cable.

22. The tool of claim 21 wherein the portions of the ends of the meshing slots and teeth contacting each other are adjacent to the die surfaces.

* * * * *

UNITED STATES PATENT AND TRADEMARK OFFICE

CERTIFICATE OF CORRECTION

PATENT NO. : 5,138,864

DATED : August 18, 1992

INVENTOR(S) : Andrew J. Tarpill

It is certified that error appears in the above-indentified patent and that said Letters Patent is hereby corrected as shown below:

Column 6, line 17, Claim 1, "suffy" should read --fully--.

Column 7, line 36, Claim 11, "too" should read --tool--.

Column 9, line 14, Claim 14, "pane" should read --plane--.

Signed and Sealed this

Twenty-eighth Day of September, 1993

Bruce Lehman

*Attest:*

BRUCE LEHMAN

*Attesting Officer*

*Commissioner of Patents and Trademarks*